US007726406B2

(12) United States Patent
Xu

(10) Patent No.: US 7,726,406 B2
(45) Date of Patent: Jun. 1, 2010

(54) DISSOLVABLE DOWNHOLE TRIGGER DEVICE

(76) Inventor: Yang Xu, 9715 Green Valley La., Houston, TX (US) 77064

( * ) Notice: Subject to any disclaimer, the term of this patent is extended or adjusted under 35 U.S.C. 154(b) by 575 days.

(21) Appl. No.: 11/522,706

(22) Filed: Sep. 18, 2006

(65) Prior Publication Data

US 2008/0066923 A1 Mar. 20, 2008

(51) Int. Cl.
*E21B 23/00* (2006.01)

(52) U.S. Cl. ..... 166/376; 166/381; 166/317

(58) Field of Classification Search ..... 166/373, 166/376, 381, 383, 317
See application file for complete search history.

(56) References Cited

U.S. PATENT DOCUMENTS

| | | | | |
|---|---|---|---|---|
| 3,211,232 | A | 10/1965 | Grimmer | |
| 4,194,566 | A | 3/1980 | Maly | |
| 4,314,608 | A | 2/1982 | Richardson | |
| 4,374,543 | A | 2/1983 | Richardson | |
| 4,390,065 | A | 6/1983 | Richardson | |
| 5,425,424 | A * | 6/1995 | Reinhardt et al. | 166/291 |
| 5,479,986 | A | 1/1996 | Gano et al. | |
| 5,685,372 | A | 11/1997 | Gano | |
| 5,709,269 | A | 1/1998 | Head | |
| 5,765,641 | A | 6/1998 | Shy et al. | |
| 5,992,289 | A | 11/1999 | George et al. | |
| 6,026,903 | A | 2/2000 | Shy et al. | |
| 6,076,600 | A | 6/2000 | Vick, Jr. et al. | |
| 6,155,350 | A | 12/2000 | Melenyzer | |
| 6,189,618 | B1 | 2/2001 | Beeman et al. | |
| 6,220,350 | B1 | 4/2001 | Brothers et al. | |
| 6,279,656 | B1 | 8/2001 | Sinclair et al. | |
| 6,382,234 | B1 | 5/2002 | Birckhead et al. | |
| 6,431,276 | B1 | 8/2002 | Robb et al. | |
| 6,779,600 | B2 | 8/2004 | King et al. | |
| 2003/0037921 | A1 | 2/2003 | Goodson, Jr. | |
| 2004/0251025 | A1 * | 12/2004 | Giroux et al. | 166/291 |
| 2005/0092363 | A1 | 5/2005 | Richard et al. | |
| 2005/0092484 | A1 | 5/2005 | Evans | |

(Continued)

FOREIGN PATENT DOCUMENTS

EP 0518371 A3 12/1992

(Continued)

OTHER PUBLICATIONS

Baker Hughes Incorporated, Model "E" Hydro-Trip Pressure Sub, Product Family No. H79928, Sep. 25, 2003, pp. 1-4, Baker Hughes Incorporated, Houston, Texas, USA.

(Continued)

*Primary Examiner*—David J Bagnell
*Assistant Examiner*—David Andrews
(74) *Attorney, Agent, or Firm*—Greenberg Traurig LLP; Anthony F. Matheny

(57) ABSTRACT

A trigger device for setting a downhole tool is disclosed. The trigger device includes a retaining member that prevents the downhole tool from setting until it is properly positioned within the well. Regardless of the type of downhole tool or the type of trigger device, the retaining member includes a dissolvable material that dissolves when contacted by a solvent. The dissolvable material is preferably one that dissolves at a known rate so that the amount of time necessary for the downhole tool to set is pre-determined. Preferably, the solvent is a water-based or hydrocarbon-based drilling fluid or mud.

7 Claims, 4 Drawing Sheets

U.S. PATENT DOCUMENTS

| | | | | |
|---|---|---|---|---|
| 2005/0161224 | A1 | 7/2005 | Starr et al. | |
| 2005/0205264 | A1 | 9/2005 | Starr et al. | |
| 2006/0131031 | A1 * | 6/2006 | McKeachnie et al. | 166/376 |
| 2007/0125532 | A1 * | 6/2007 | Murray et al. | 166/179 |

FOREIGN PATENT DOCUMENTS

| | | | |
|---|---|---|---|
| EP | 0518371 | B1 | 12/1992 |
| EP | 0999337 | B1 | 2/2006 |

OTHER PUBLICATIONS

Innicor Completion Systems, HydroTrip Plug Sub, Product No. 658-0000, Jul. 26, 2004, p. 1, Innicor Completion Systems, Canada.

TAFA Incorporated, Application Data, TAFA Series 300-301 Dissolvable Metal, 1989, pp. 1-3, TAFA Incorporated, Concord, New Hampshire, USA.

* cited by examiner

DISSOLVABLE DOWNHOLE TRIGGER DEVICE

BACKGROUND

1. Field of Invention

The present invention is directed to trigger devices for actuating downhole tools and, in particular, trigger devices having a dissolvable material such that when the dissolvable material dissolves, the trigger device is activated and the downhole tool is actuated.

2. Description of Art

Some downhole tools need to be retained in an unset position until properly placed in the well. It is only when they are properly located within the well that the downhole tool is set. Such downhole tools in the past have had trigger mechanisms that are retained in an immovable position while the downhole tool is being "run" into the well and properly placed within the well. One prior technique for holding the trigger mechanism immobile until the downhole tool is properly placed in the well involves disabling the trigger with a mechanical device that is held against movement by a Kevlar® high strength fiber and an associated electrically powered heat source generally powered by stored batteries in the downhole tool. The generation of sufficient heat burns the fibers and releases the trigger so that the tool can set. Such a system is described in U.S. Pat. No. 5,558,153. One problem with this trigger mechanism is that it is extremely difficult to generate sufficient heat downhole to burn the fibers without damaging adjacent components. This is because the physical size of the battery pack must be large enough to provide sufficient energy to generate the necessary temperature, for the necessary duration, to break the fibers. Another issue is the very high temperatures needed to break the fibers and the effect on the overall design of the downhole tool from having to keep heat sensitive components away from the heated area.

Another prior trigger mechanism includes a battery operated heater coil in a downhole tool to release the trigger by applying heat and melting a plug to start the setting sequence. This design is reflected in U.S. Pat. No. 6,382,234. As with the other prior attempt, the size of the battery to provide the required electrical capacity to create enough heat to melt the plug presents a space concern in a downhole tool where space for a large power supply is at a premium. Further, the heat sensitive components must be shielded from the heater coil. The cost and the reliability of a large battery pack is also can be a problem. Additionally, safety is another issue because some batteries need special shipping and handling requirements.

Still other alternatives involve the large battery pack to accomplish a release of the trigger. For example, U.S. Pat. No. 5,558,153 also suggests using solder wire that melts at relatively low temperatures to be the trigger material or using the stored power in the battery to advance a knife to physically cut the fiber as opposed to breaking it with a battery operated heat source.

In other prior attempts, pressures from fluids pumped down the well are used to break shear pins on the downhole tools. The use of shear pins, however, requires elevated directional pressure forces acting on the shear pins. However, in some instances sufficient pressure may not be available. Alternatively, in some wells, pressure, even if available, cannot be utilized because additional intervention steps are required which results in the well experiencing undesirable "downtime" for the additional intervention steps. Additionally, in some instances, the shear pins fail to shear when they are supposed to, causing further delays.

Accordingly, prior to the present inventions trigger devices and methods for actuating downhole tools have been desired in the art which: permit customization of the trigger device such that the amount of time for the trigger device to be activated is pre-determined; permit setting of downhole tools without the need for high pressures or heat; allow the setting of the downhole tool without additional intervention steps and, thus, decreasing the costs associated with actuating the downhole tools.

SUMMARY OF INVENTION

Broadly, the trigger devices for downhole tools have a housing or body, an actuating member, and a retaining member. The retaining member includes a dissolvable material. The retaining member prevents movement of the actuating member until the dissolving material of the retaining member is dissolved. Upon dissolution of the dissolving material, the retaining member is no longer capable of preventing the movement of the actuating member. As a result, the actuating member moves and, thus, sets the downhole tool. In certain specific embodiments, the dissolution of the dissolving material sets the downhole tool by one or more of freeing a piston to move, allowing fluid flow through a port in the downhole tool, or by any other mechanism known to persons skilled in the art.

The dissolving material may be any material known to persons of ordinary skill in the art. Preferably, the dissolvable material operates as a time delay device that can be calibrated with the passage of time. Thus, the dissolvable material disintegrates, degrades, or dissolves within a known period of time such that the downhole tool, regardless of type of downhole tool, can be placed in a desired location in the wellbore and the downhole tool actuated within a known period of time. Accordingly, the dissolvable material has a known rate of dissolution such that an operator of the downhole tool is able to pre-determine the amount to time for the dissolvable material to dissolve and, thus, the amount of time for the downhole tool to set.

In certain specific embodiments, solvents, such as water or hydrocarbon based drilling fluids or mud, can be used to dissolve the dissolving material. Solvents include liquids, gases or other fluids, but do not include heat.

Further, because the dissolvable materials can be easily calibrated, they can be customized for various depth wells without concern for the pressures or temperatures within the well. The dissolvable materials can also be customized to sufficiently dissolve and set the downhole tools.

Additionally, the inclusion of the dissolvable material to maintain the downhole tool in its "unset" or "run-in" position permits the easy formation of various sized trigger devices depending on the size of the housing or chamber of the downhole tool in which the trigger device is placed. As necessary, additional or less dissolvable material may be used to form the retaining member to properly fit within the housing of the downhole tool.

Further, dissolution of the dissolvable material by a solvent does not require generation of heat. As a result, no heating element or batteries are required. Therefore, a simpler, more efficiently sized, and less expensive designed downhole tool is achieved.

In one aspect, one or more of the foregoing advantages have been achieved through the present trigger device for a downhole tool, the trigger device capable of selectively actuating the downhole tool. The trigger device comprises a housing; an actuating member operatively connected to the housing, wherein the movement of the actuating member causes a downhole tool to perform a specified function; and a restraining member operatively associated with the actuating member, the restraining member restraining movement of the actuating member with respect to the housing, wherein the restraining member comprises a dissolvable material and wherein dissolution of the dissolvable material by a dissolving fluid causes the restraining member to no longer restrain movement of the actuating member such that the actuating member is capable of moving to actuate the downhole tool.

A further feature of the trigger device is that the restraining member may further comprise a dissolvable support adjacent the dissolvable material, the dissolvable material isolating the dissolvable support at least partially from the dissolving fluid until the dissolvable material has dissolved. Another feature of the trigger device is that the actuating member may comprise a piston. An additional feature of the trigger device is that the dissolvable material may be mounted in contact with the piston. Still another feature of the trigger device is that the housing may include a passage in fluid communication with the dissolvable material and a rupture disk. A further feature of the trigger device is that the housing may have two chambers separated by the piston, and the dissolvable material is disposed in a port in the housing leading to one of the chambers such that dissolution of the dissolvable material opens the port to allow the dissolving fluid to enter said one of the chambers to create a net differential force on the piston causing actuation of the downhole tool. Another feature of the trigger device is that the port, when opened, may communicate hydrostatic well pressure to one of the chambers. An additional feature of the trigger device is that each of the chambers in the housing may be initially pressurized to a greater pressure than a hydrostatic pressure in the well at a desired setting depth, such that the port, when opened, allows the pressure in one of the chambers to reduce to the hydrostatic pressure, to create the differential force on the piston. Still another feature of the trigger device is that the dissolvable material may comprise a sleeve mounted around a portion of the actuating member. A further feature of the trigger device is that the at least one dissolvable material may comprise a polymer. Another feature of the trigger device is that the polymer may comprise a bio-degradable polymer. An additional feature of the trigger device is that the polymer may comprise a polyvinyl-alcohol based polymer. Still another feature of the trigger device is that the trigger device may further comprise a port in the housing, wherein the restraining member opens the port as a result of dissolution of the dissolvable material to allow wellbore fluid to enter the housing. A further feature of the trigger device is that the restraining member may comprise a plurality of sleeve segments and the dissolvable material is interspersed between and joined to the sleeve segments to maintain them together until dissolution of the dissolvable material.

In another aspect, one or more of the foregoing advantages have been achieved through the present improved trigger device for actuating a downhole tool having an actuating member. The improvement comprises at least one dissolvable material operatively associated with a restraining member wherein dissolution of the dissolvable material by a wellbore fluid causes the restraining member to no longer restrain movement of the actuating member such that the actuating member is capable of moving, causing actuation of the downhole tool. A further feature of the improvement is that the dissolvable material may be a bio-degradable polymer.

In another aspect, one or more of the foregoing advantages have been achieved through the present method of selectively actuating a downhole tool. The method comprises the steps of: (a) retaining an actuating member of a downhole tool with a restraining member, wherein the restraining member comprises at least one dissolvable material; (b) lowering the tool into a wellbore and contacting the dissolvable material with a dissolving fluid capable of dissolving the dissolvable material; and (c) dissolving the dissolvable material for a period of time such that the restraining member can no longer restrain the actuating member, causing the actuating member to move and actuate the downhole tool.

A further feature of the method of selectively actuating a downhole tool it that step (b) may be performed by contacting the dissolvable material with a wellbore fluid. Another feature of the method of selectively actuating a downhole tool it that step (b) may be performed by isolating the dissolvable material from wellbore fluid in the wellbore until reaching a desired setting depth, then contacting the dissolvable material with the wellbore fluid. An additional feature of the method of selectively actuating a downhole tool it that step (b) may comprise contacting the dissolvable material with wellbore fluid in the wellbore while lowering the tool into the wellbore.

The trigger devices and methods disclosed herein have one or more of the following advantages: permitting customization of the trigger device such that the amount of time for the trigger device to be activated is pre-determined; permitting setting of downhole tools without the need for high pressures or heat; allowing the setting of the downhole tool without additional intervention steps and, thus, decreasing the costs associated with actuating the downhole tools.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1A:
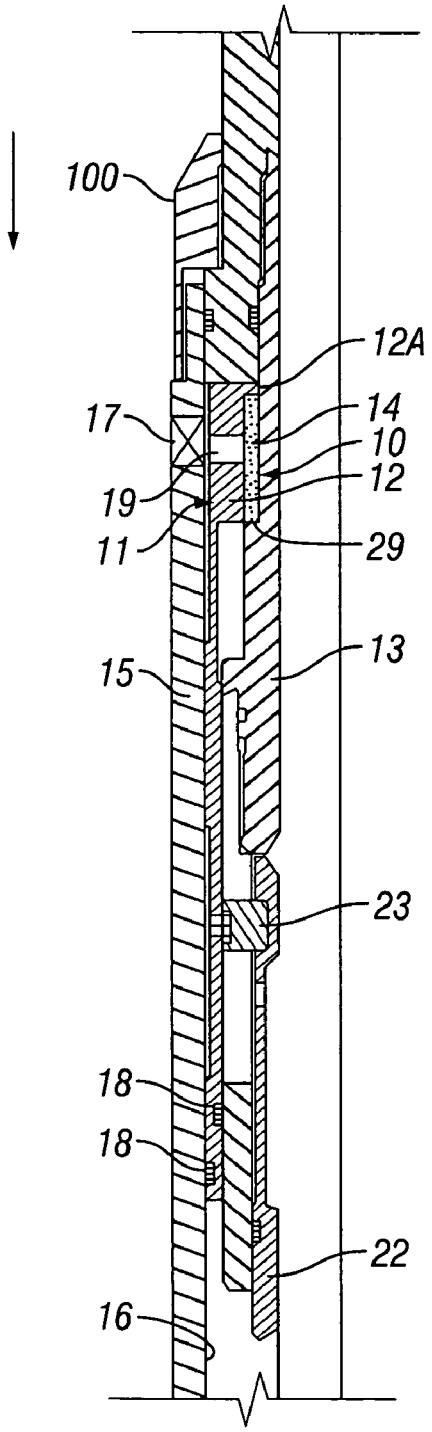
FIG. 1A is a cross-sectional view of one specific embodiment of the trigger device of the present invention shown in its initial or run-in position.
Figure 1B:
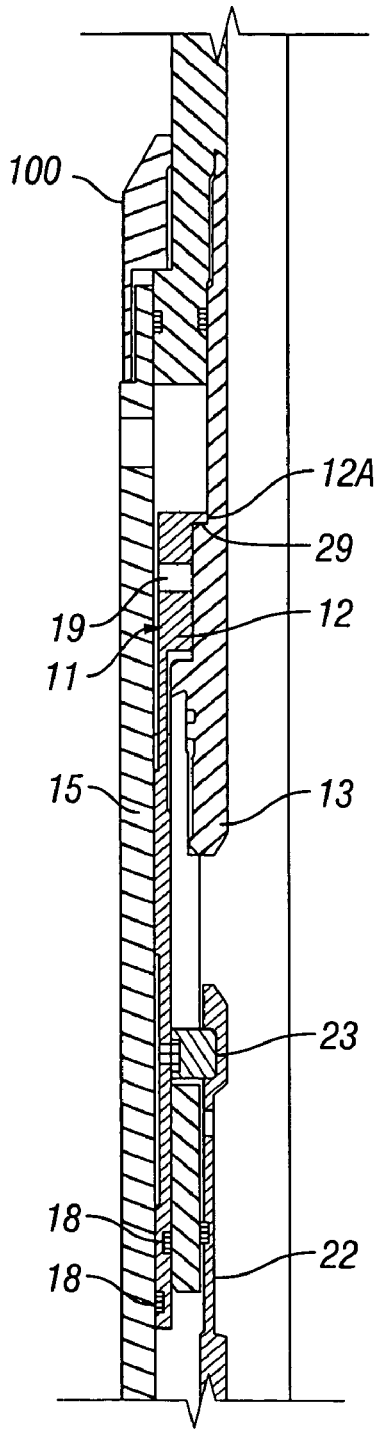
FIG. 1B is a cross-sectional view of the trigger device shown in FIG. 1A in its actuated position.

Referring to FIGS. 1A and 1B, in one embodiment, trigger device 10 is included as part of downhole tool 100. Downhole tool 100 is lowered on a string of conduit into the well and may be used for setting a packer, a bridge plug, or various other functions. Trigger device 10 has actuating member 11, which as shown in FIGS. 1A and 1B, is piston 12. Generally, movement of actuating member 11, e.g., piston 12, sets downhole tool after it is properly located in a well (not shown). As shown in FIG. 1A, piston 12 is in its initial or "run-in" position. The initial position is the position prior to actuation of downhole tool 100. FIG. 1B shows piston 12 in the actuated position.

In this example, piston 12 comprises a sleeve carried in an annular chamber around a central mandrel assembly 13 of tool 100 and within a housing 15 of tool 100. Piston 12 has inner and outer seals 18 that slidably engage mandrel assembly 13 and the inner side wall of housing 16 when actuated. Piston 12 is connected to an actuating member 22 by key 23 extending through an elongated slot in mandrel assembly 13 to move actuating member 22 downward when piston 12 moves downward. Actuating member 22 performs a desired function, such as setting a packer. When actuated, a force is applied to piston 12 in the direction of the arrow. The force can come from a variety of sources such as hydrostatic pressure, fluid pressure pumped from the surface, or various springs or other energy storage devices or equivalents. When applied, the force would otherwise move piston 12 in the direction of the arrow except that restraining member 14 prevents movement of piston 12.

Retaining member 14 maintains actuating member 11, e.g., piston 12, in the run-in position. As shown in FIG. 1, retaining member 14 is completely formed of a dissolvable material. However, it is to be understood that retaining member 14 may be only partially formed by dissolvable material such that dissolvable material comprises only a portion of retaining member 14. In this example, retaining member 14 comprises a sleeve within an inner diameter portion of piston 12. Retaining member 14 and piston 12 are arranged so that piston 12 cannot move relative to retaining member 14 in the direction of the arrow. An inward extending lip 12*a* of piston 12 contacts an upper end of retaining member 14 to prevent downward movement of piston 12 relative to retaining member 14.

Retaining member 14 has an inner diameter that receives mandrel assembly 13. Retaining member 14 is mounted to mandrel assembly 13 in a manner to prevent movement of retaining member 14 relative to mandrel assembly 13 in the direction of the arrow. In this embodiment, a lower end of retaining member 14 engages an upward facing shoulder 29 of mandrel assembly 13 to prevent downward movement.

The term "dissolvable material" as used herein for retaining member 14 means that the material is capable of dissolution in a solvent disposed within the well, such as in tubing, casing, the string, or the downhole tool. The term "dissolvable" is understood to encompass the terms degradable and disintegrable. Likewise, the terms "dissolved" and "dissolution" also are interpreted to include "degraded" and "disintegrated," and "degradation" and "disintegration," respectively.

The dissolvable material may be any material known to persons of ordinary skill in the art that can be dissolved, degraded, or disintegrated over an amount of time by a temperature or fluid such as water-based drilling fluids, hydrocarbon-based drilling fluids, or natural gas. Preferably, the dissolvable material is calibrated such that the amount of time necessary for the dissolvable material to dissolve is known or easily determinable without undue experimentation. Suitable dissolvable materials include polymers and biodegradable polymers, for example, polyvinyl-alcohol based polymers such as the polymer HYDROCENE™ available from Idroplax, S.r.l. located in Altopascia, Italy, polylactide ("PLA") polymer 4060D from Nature-Works™, a division of Cargill Dow LLC; TLF-6267 polyglycolic acid ("PGA") from DuPont Specialty Chemicals; polycaprolactams and mixtures of PLA and PGA; solid acids, such as sulfamic acid, trichloroacetic acid, and citric acid, held together with a wax or other suitable binder material; polyethylene homopolymers and paraffin waxes; polyalkylene oxides, such as polyethylene oxides, and polyalkylene glycols, such as polyethylene glycols. These polymers may be preferred in water-based drilling fluids because they are slowly soluble in water.

In calibrating the rate of dissolution of the dissolvable material, generally the rate is dependent on the molecular weight of the polymers. Acceptable dissolution rates can be achieved with a molecular weight range of 100,000 to 7,000,000. Thus, dissolution rates for a temperature range of 50° C. to 250° C. can be designed with the appropriate molecular weight or mixture of molecular weights.

In one embodiment, the dissolvable material dissolves, degrades, or disintegrates over a period of time ranging from 1 hour to 240 hours and over a temperature range from about 50° C. to 250° C. Preferably, both time in contact with a solvent and temperature act together to dissolve the dissolvable material; however, the temperature should less than the melting point of dissolvable material. Thus, the dissolvable material does not begin dissolving solely by coming into contact with the solvent which may be present in the wellbore during running in of downhole tool 100. Instead, an elevated temperature must also be present to facilitate dissolution of the dissolvable material by the solvent. Additionally, water or some other chemical could be used alone or in combination with time and/or well temperature to dissolve the dissolvable material. Other fluids that may be used to dissolve the dissolvable material include alcohols, mutual solvents, and fuel oils such as diesel.

It is to be understood that the apparatuses and methods disclosed herein are considered successful if the dissolvable material dissolves sufficiently such that the actuating member, e.g., piston, is moved from its initial or "run-in" position to its actuated or "setting" position so that the downhole tool is set. In other words, the apparatuses and methods are effective even if all of the dissolvable material does not dissolve. In one specific embodiment, at least 50% of the dissolvable material dissolves. In other specific embodiment, at least 90% of the dissolvable material dissolves.

Still with reference to FIG. 1, trigger device 10 also includes rupture disk 17 that is designed to break-away at predetermined depths due to hydrostatic pressure of the well fluid or fluid pressures applied by pumps at the surface of the well. Rupture disks 17 are known in the art. Aperture 19 is in fluid communication with rupture disc 17 though piston 12. Aperture 19 also is in fluid communication with retaining member 14.

In operation, downhole tool 100 is lowered into a well (not shown) containing a well fluid by a string (not shown) of conduit that would be attached to mandrel assembly 13. In one technique, during the running-in, the portion of piston 12 above seals 18 and retaining member 14 are isolated from wellbore fluid, and actuating member 22 and the portion of piston 12 below seals 18 are also isolated from wellbore fluid. The pressure on the upper and lower sides of piston seals 18 would be at atmospheric. The pressure difference on the exterior and interior sides of rupture disk 17 would be the difference between the hydrostatic pressure of the well fluid and atmospheric. Upon reaching a certain depth or a certain hydrostatic pressure of well fluid, rupture disk 17 breaks away exposing retaining member 14, through aperture 19, to the wellbore environment. Fluid from the wellbore such as water, drilling fluid, or some other solvent capable of dissolving the dissolvable material of retaining member 14 then contacts retaining member 14. This fluid is at the hydrostatic pressure of the wellbore fluid and exerts a downward force on piston 12 because the pressure below seals 18 is atmospheric. This downward force on piston 12 is initially resisted by retaining member 14. After a sufficient amount of time, preferably pre-determined by the operator of the downhole tool, a sufficient amount of the dissolvable material dissolves, disintegrates, or degrades such that retaining member 14 is no longer able to maintain actuating member 11, e.g., piston 12, in its "run-in" position. As a result, actuating member 11, e.g., piston 12, moves downward and actuates downhole tool 100 by moving actuating member 22 downward to the position shown in FIG. 1B.

Figure 2:
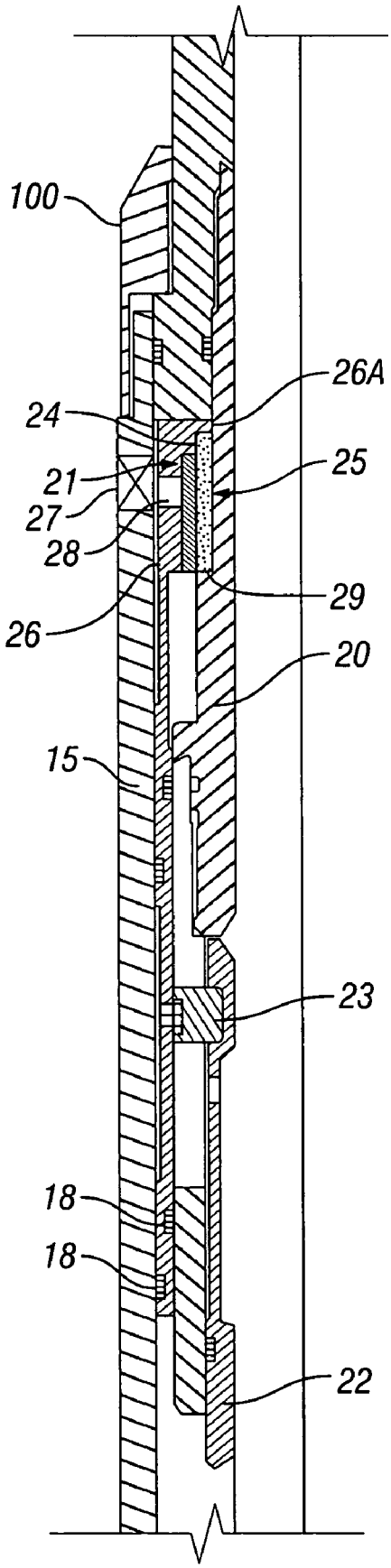
FIG. 2 is a cross-sectional view of another specific embodiment of the trigger device of the present invention.

In another preferred embodiment illustrated in FIG. 2, the trigger device of downhole tool 100 is similar to trigger device 10 in FIG. 1. The only difference is that the trigger device includes dissolvable member 21 having a dissolvable material and a dissolvable support 24. Dissolvable support 24 is sturdier than dissolvable member 21, thereby allowing retaining member 25 to withstand increased force on piston 26. Dissolvable member 21 is a sleeve carried with dissolvable support 24, which is also a sleeve. The upper end of dissolvable member 21 contacts lip 12*a* of piston 12, but the lower end of dissolvable member 21 does not contact shoulder 29 of mandrel assembly 13, unlike retaining member 14 of FIG. 1. The upper end of dissolvable support 24 contacts lip 26*a* of piston 26, and the lower end of dissolvable support 24 contacts the upward facing shoulder on the central mandrel assembly 20.

As shown in FIG. 2, dissolvable member 21 is exposed to the drilling fluid first and, thus, is dissolved first. Wellbore fluid is unable to contact dissolvable support 24 until dissolvable member 21 is substantially dissolved. Meanwhile, dissolvable support 24 holds piston 26 in place. After dissolvable member 21 is sufficiently dissolved, dissolvable support 24 is exposed to the wellbore fluid for dissolution. Piston 26 is not allowed to move until dissolvable support 24 is dissolved. Dissolvable member 21 could be a liner or coating formed on the inner diameter of dissolvable support 24.

In one specific embodiment, the material of dissolvable support 24 may dissolve in a relatively short amount of time, especially in comparison with the amount of time for the material of dissolvable member 21 to dissolve. As a result, dissolvable support 24 may dissolve in such a short amount of time that piston 26 does not gradually begin to move but, instead, moves in one quick motion upon the quick dissolution of dissolvable support 24. Therefore, this embodiment is appropriate for downhole tools in which a quick, one-motion actuation of piston 26 is desired.

Although dissolvable support 24 may be formed of any suitable dissolvable material known in the art desired or necessary to provide the appropriate support to dissolvable member 21, in one preferred embodiment, the material of dissolvable support 24 is TAFA Series 300-301 Dissolvable Metal from TAFA Incorporated of Concord, N.H. This material is preferred because of its strength and relatively quick dissolution for providing a clean and quick actuation of piston 26.

The embodiment of FIG. 2 operates in a similar manner compared to the embodiment shown in FIG. 1. Rupture disk 27 breaks away at a certain depth or pressure permitting fluid to flow through aperture 28 and dissolve dissolvable material 22 and, thus, dissolvable support 24 in the same manner as discussed above with respect to FIG. 1.

Figure 3:
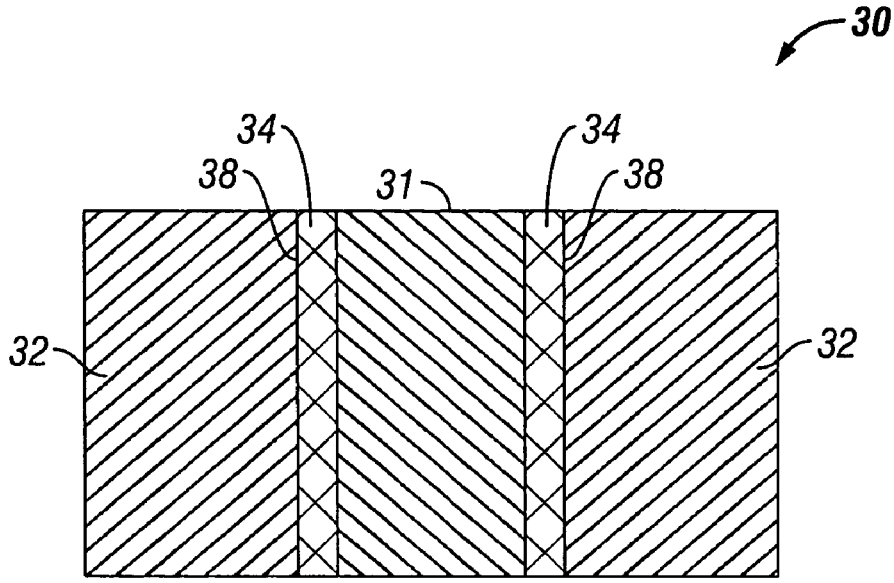
FIG. 3 is a cross-sectional view of an additional specific embodiment of the trigger device of the present invention.

FIG. 3 illustrates still another embodiment in which trigger device 30 includes piston 31 held in housing or body 32 by restraining member 34. Restraining member 34 comprises a dissolvable member formed of a dissolvable material. In one embodiment, restraining member 34 is formed, at least partially, of dissolvable material but it could also be formed completely of dissolvable material. Restraining member 34 in this example comprises a sleeve located between the outer diameter of piston 31 and the inner diameter of housing 32. Restraining member 34 is attached to housing 32 and piston 31 by suitable means, such as adhesive, bonding, fasteners or other structural members.

When the dissolvable material of the dissolvable member is dissolved through contact with a solvent, the downhole tool (not shown) is set by the movement of piston 31. Alternatively, the downhole tool can be set by the flow of fluid through passages 38 formed by the dissolution of the dissolvable material, with or without movement of piston 31.

Figure 4:
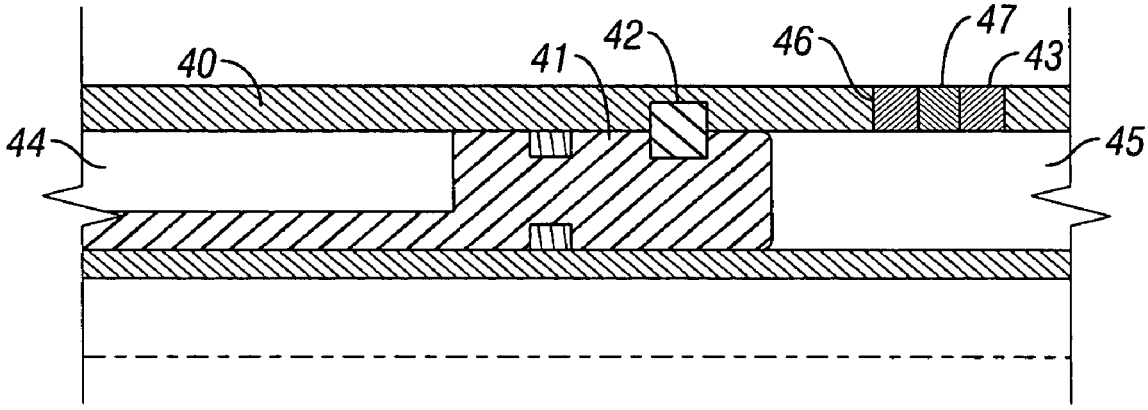
FIG. 4 is a cross-sectional view of still another specific embodiment of the trigger device of the present invention.

With respect to FIG. 4, in yet another embodiment, the trigger device includes piston 41 held within the bore of a housing 40 by a shear device 42, such as a shear pin or screw, and retaining member 43. Shear device 43 fits within a receptacle in the side wall of housing 40. Piston 41 separates atmospheric or low pressure chamber 44 from chamber 45. Chamber 45 is also initially at atmospheric or low pressure that is below the surrounding hydrostatic pressure at the anticipated depth for setting the downhole tool (not shown). Retaining member 43 is a plug that is disposed in port 46 of chamber 45. Thus, piston 41 remains stationary as long as retaining member 43 is in place.

Although this embodiment is disclosed as having shear device 42, it is to be understood that a shear device is not required. For example, in an embodiment in which piston 41 is in pressure balance between chambers 44 and 45, shear device 42 is not required. Retaining member 43 includes a dissolvable core 47 formed at least partially of a dissolvable material that dissolves in the circumstances described above.

Upon dissolution of dissolvable material of core 47, port 46 is opened to allow fluid to pass through port 46 into chamber 45. As a result, sufficient differential pressure is place on piston 41 to break shear device 42, if used, and to set the downhole tool. In this example, well hydrostatic pressure is used to move piston 41 after dissolution of the dissolvable material of dissolvable core 47.

As an alternative method of operation for the trigger device described in FIG. 4, chambers 44 and 45 could be initially pressurized prior to running in to a pressure greater than the hydrostatic wellbore pressure at the desired setting depth. The pressures initially in chambers 44 and 45 could be the same or balanced, obviating the need for a shear pin. Therefore, when the dissolvable material of core 47 dissolves, the pressure in chamber 45, which was initially higher than the hydrostatic pressure, now drops to hydrostatic pressure. The pressure in chamber 44 remains at the high level, creating a pressure differential across piston 41. Due to the pressure differential between the two chambers 44, 45, piston 41 moves to the right and the downhole tool sets.

Figure 5:
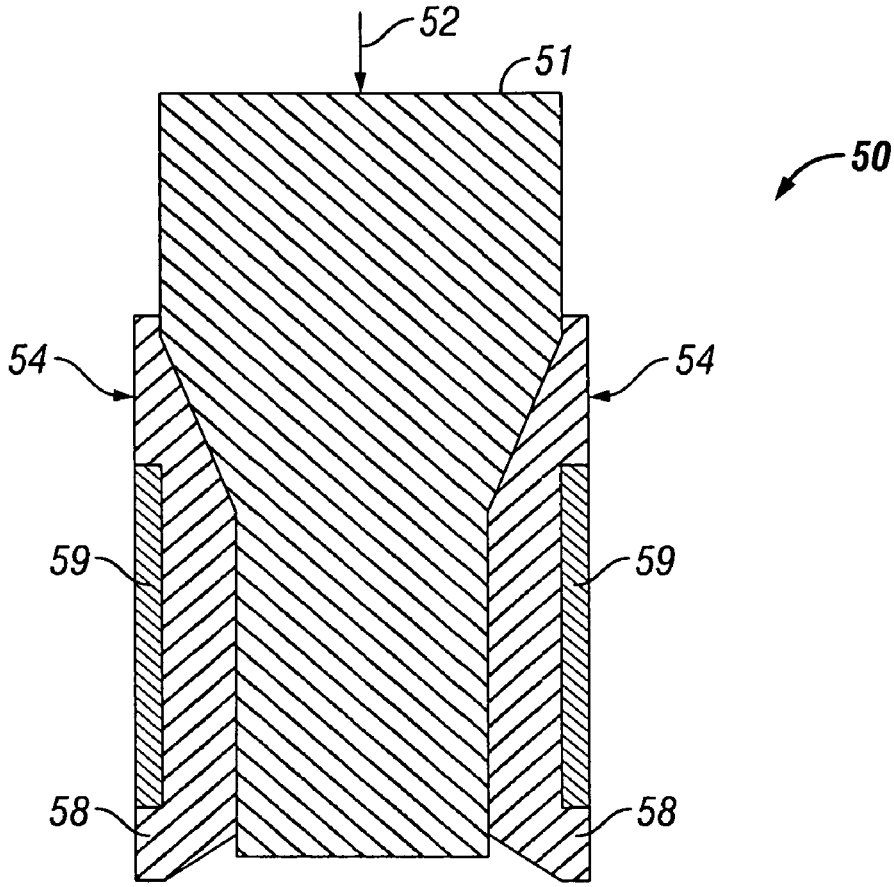
FIG. 5 is a cross-sectional view of a further specific embodiment of the trigger device of the present invention.

Referring now to FIG. 5, in another embodiment trigger device 50 includes piston 51 having an applied force in the direction of arrow 52 acting upon it. The force would otherwise make piston 51 move, however restraining member 54 prevents such movement. As mentioned above, the force can come from a variety of sources such as hydrostatic pressure, various springs or other energy storage devices, or equivalents. In this embodiment, restraining member 54 is a pair of semi-cylindrical sleeve segments 56, 58 that are longitudinally split and held together by dissolvable member 59 formed at least in part by a dissolvable material. Dissolvable member 59 is a band or sleeve extending around sleeve segments 56, 58 to retain them in the configuration of a sleeve. Upon dissolution of dissolvable member 59, as discussed in greater detail above, sleeve segments 56, 58 are released from piston 51. As a result, the force is no longer restrained and piston 51 moves, causing downhole tool (not shown) to actuate.

The design of FIG. 5 contemplates variations such as retaining piston 51 having a c-ring (not shown) whose open end is held fast by dissolvable member 59 against piston 51 to keep piston 51 from moving. In other words, c-ring is held in a contracted position by dissolvable member 59 and is biased by its own resiliency to an expanded position. When dissolvable member 59 is dissolved, the c-ring is expands, thereby releasing piston 51 so that piston 51 moves to set the downhole tool.

Although the trigger devices described in greater detail with respect to FIGS. 1-5 are directed to actuation of a piston as the actuating member, it is to be understood that the trigger device disclosed herein may be used in connection with any type of actuatable device known to persons of ordinary skill in the art. For example, the actuating member may be valve, ring or collet of a retractable seat such as a retractable ball seat, or any other device or member of a downhole tool that can be actuated.

Figure 6:
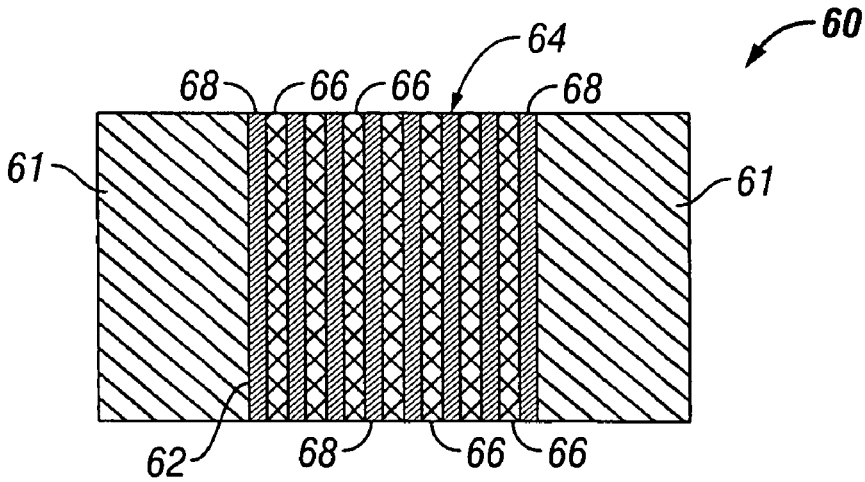
FIG. 6 is a cross-sectional view of yet another specific embodiment of the trigger device of the present invention.

As illustrated in FIG. 6, trigger device 60 does not include any piston. Instead, trigger device includes housing or body 61 having aperture 62 that is initially plugged by restraining member 64. Restraining member 64 includes dissolvable member 66 formed from a dissolvable material. In one embodiment (shown in FIG. 6), restraining member 64 is formed partially by dissolvable member 66 and, thus, a dissolvable material, and partially by filler 68. Filler 68 can be plastic, metal, or any material desired or necessary to block aperture 62 prior to dissolution of dissolving member 66. In another embodiment, retraining member 64 is formed completely by dissolvable member 66 and, thus, the dissolvable material.

Upon dissolution of dissolvable member 66 caused by contact with a solvent, the actuating member (not shown) disposed adjacent aperture 62 can no longer resist the differential pressure acting upon it. Therefore, the differential pressure causes the actuating member to move and, thus, set the downhole tool.

In yet other embodiments, the dissolvable material may, upon dissolution, produce or release an acid or other corrosive product that is capable of severing cords or other structural components to facilitate setting the downhole tool, such as dissolving the retaining member. These products could also be used to dissolve components of the string that are no longer needed.

It is to be understood that the invention is not limited to the exact details of construction, operation, exact materials, or embodiments shown and described, as modifications and equivalents will be apparent to one skilled in the art. For example, the retaining member may be formed completely out of the dissolvable material. Alternatively, dissolvable fasteners or other structural components may hold retaining member in place. Upon dissolution, the retaining member falls out of or otherwise becomes removed from its retaining position and, thus, the actuating member is permitted to move. Moreover, although movement of a piston is shown in most of the embodiments herein as the apparatus and method for setting the downhole tool, any type of trigger device for the downhole tool is envisioned regardless of shape or the nature of its movement or whether the movement directly or indirectly sets the downhole tool. Accordingly, the invention is therefore to be limited only by the scope of the appended claims.

What is claimed is:

1. A trigger device for a downhole tool, the trigger device capable of selectively actuating the downhole tool, the trigger device comprising:

a housing comprising a housing passage disposed in a wall of the housing;

a mandrel disposed within the housing;

an actuating member operatively connected to the housing wherein the movement of the actuating member causes a downhole tool to perform a specified function; and a restraining member operatively associated with the actuating member, the restraining member restraining movement of the actuating member with respect to the housing, the restraining member comprising a dissolvable material such that dissolution of the dissolvable material by a dissolving fluid causes the restraining member to no longer restrain movement of the actuating member such that the actuating member is capable of moving to actuate the downhole tool, wherein the actuating member comprises a piston in sliding engagement with the mandrel and an inner wall surface of the housing, the piston comprising a piston inner diameter portion and a piston port, the piston port being in fluid communication with the piston inner diameter portion and the housing passage, and wherein the dissolvable material comprises a sleeve, the sleeve being disposed within the piston inner diameter portion, and the sleeve comprising a sleeve inner diameter portion that is in contact with the mandrel and a lower end that engages an upward facing shoulder of the mandrel.

2. The trigger device of claim 1, wherein the at least one dissolvable material comprises a polymer.

3. The trigger device of claim 2, wherein the polymer comprises a bio-degradable polymer.

4. The trigger device of claim 3, wherein the polymer comprises a polyvinyl-alcohol based polymer.

5. The trigger device of claim 1, wherein the housing passage includes a rupture disk.

6. A method of selectively actuating a downhole tool, the method comprising the steps of:

(a) retaining an actuating member of a downhole tool with a restraining member, wherein the restraining member comprises at least one dissolvable material, the downhole tool comprising a housing having a mandrel disposed therein and a housing passage disposed on a wall of the housing, the actuating member comprising a piston having a piston inner diameter and a piston port, the piston port being in fluid communication with the housing port and the restraining member being disposed within the piston inner diameter;

(b) lowering the tool into a welibore and contacting the dissolvable material with a dissolving fluid capable of dissolving the dissolvable material, the dissolving fluid flowing from the weilbore, through the housing passage, and through the piston port to the dissolvable material, wherein the dissolvable material is isolated from the dissolving fluid until the downhole tool reaches a desired setting depth; and (c) dissolving the dissolvable material for a period of time such that the restraining member can no longer restrain the actuating member, causing the actuating member to move and actuate the downhole tool.

7. The method of claim 6, wherein step (b) is performed by contacting the dissolvable material with a wellbore fluid.

* * * * *